US007434591B2

(12) United States Patent
Church

(10) Patent No.: US 7,434,591 B2
(45) Date of Patent: Oct. 14, 2008

(54) RAIN PROTECTION UMBRELLA

(76) Inventor: Godfrey B. Church, 16 Larkspur Dr., Parsippany, NJ (US) 07054

( * ) Notice: Subject to any disclaimer, the term of this patent is extended or adjusted under 35 U.S.C. 154(b) by 0 days.

(21) Appl. No.: 10/710,217

(22) Filed: Jun. 25, 2004

(65) Prior Publication Data

US 2006/0005871 A1 Jan. 12, 2006

(51) Int. Cl.
*A45B 15/00* (2006.01)
*E04H 15/28* (2006.01)

(52) U.S. Cl. ..... 135/33.41; 135/33.2; 135/98; 135/16

(58) Field of Classification Search ..... 135/98, 135/115, 117, 119, 16, 21, 33.2, 33.41, 907
See application file for complete search history.

(56) References Cited

U.S. PATENT DOCUMENTS

| | | | | | |
|---|---|---|---|---|---|
| 152,739 | A | * | 7/1874 | Gildersleeve | 135/98 |
| 171,967 | A | * | 1/1876 | Arnold | 135/98 |
| 278,124 | A | * | 5/1883 | Gause | 135/98 |
| 373,378 | A | * | 11/1887 | Rumrille | 135/98 |
| 574,091 | A | * | 12/1896 | Irvine | 135/98 |
| 1,072,340 | A | * | 9/1913 | Liljegran | 135/98 |
| 1,431,243 | A | * | 10/1922 | McKelvy | 135/117 |
| 1,854,671 | A | * | 4/1932 | Roberts | 135/98 |
| 2,221,366 | A | * | 11/1940 | Bisbing | 135/98 |
| 2,248,655 | A | * | 7/1941 | Bila | 135/115 |
| 2,502,984 | A | * | 4/1950 | Parmenter | 135/16 |
| 2,546,228 | A | * | 3/1951 | Martini | 135/33.71 |
| 2,599,141 | A | * | 6/1952 | Taylor | 135/115 |
| 2,641,770 | A | * | 6/1953 | Chapin | 135/117 |
| 2,650,401 | A | * | 9/1953 | LaMond | 135/119 |
| 2,652,845 | A | * | 9/1953 | O'Neill | 135/98 |
| 2,863,467 | A | * | 12/1958 | Hearell | 52/2.17 |
| 2,928,404 | A | * | 3/1960 | Klages | 135/98 |
| 2,961,725 | A | * | 11/1960 | McGee | 135/119 |
| 3,333,595 | A | * | 8/1967 | Bannister | 135/98 |
| 3,407,825 | A | * | 10/1968 | Doyle | 135/98 |
| 3,419,024 | A | * | 12/1968 | Nickerson | 135/98 |
| 3,441,037 | A | * | 4/1969 | Transeau | 135/119 |
| 3,800,814 | A | * | 4/1974 | Hibbert | 135/93 |
| 3,899,168 | A | * | 8/1975 | Besherse | 472/75 |

(Continued)

FOREIGN PATENT DOCUMENTS

DE 20015405 U1 * 11/2000

(Continued)

*Primary Examiner*—Winnie Yip
(74) *Attorney, Agent, or Firm*—Michael L. Greenberg, Esq.; Greenberg & Lieberman, LLC

(57) ABSTRACT

A lightweight vertical attachment shield that forms a canopy like structure for protection from falling rain when the vertical attachment shield is attached underneath any conventional umbrella in an open arrangement. The vertical attachment shield is attached about the circumference of the conventional umbrella via spring-loaded plastic clips and elastic nooses. When attached to a conventional umbrella, the vertical attachment shield has a length that extends a few inches from the ground. The vertical attachment shield includes a clear view window, as well as vent and hand openings for added convenience and comfort for the user. Alternatively, the vertical shield attachment shield attaches to unique designed umbrella via snap buttons located around the upper rim of the vertical attachment shield and on the underside of the unique designed umbrella. A vertical umbrella stand is utilized to aid in assembling and disassembling the present invention.

1 Claim, 5 Drawing Sheets

U.S. PATENT DOCUMENTS

| | | | | | |
|---|---|---|---|---|---|
| 4,022,233 | A | * | 5/1977 | Grundman | 224/187 |
| 4,336,817 | A | | 6/1982 | Shapiro | |
| 4,364,193 | A | * | 12/1982 | Visco | 135/98 |
| 4,449,542 | A | * | 5/1984 | McSwain | 135/98 |
| 4,926,893 | A | * | 5/1990 | Klopfenstein | 135/119 |
| 4,980,928 | A | | 1/1991 | Ellis | |
| 5,050,924 | A | | 9/1991 | Hansen | |
| 5,161,561 | A | * | 11/1992 | Jamieson | 135/98 |
| 5,172,712 | A | * | 12/1992 | Robinson | 135/98 |
| 5,429,147 | A | | 7/1995 | Barrington | |
| 5,592,961 | A | * | 1/1997 | Chin | 135/117 |
| 5,664,595 | A | | 9/1997 | Vonderhorst | |
| D390,696 | S | | 2/1998 | Bauman | |
| 5,740,822 | A | * | 4/1998 | Einck | 135/16 |
| 5,894,855 | A | * | 4/1999 | Gefell | 135/20.2 |
| 5,918,611 | A | * | 7/1999 | Amato | 135/16 |
| 5,937,881 | A | * | 8/1999 | Villa | 135/16 |
| 6,009,891 | A | * | 1/2000 | Surface et al. | 135/98 |
| 6,223,758 | B1 | | 5/2001 | Feldman | |
| 2002/0185167 | A1 | * | 12/2002 | Lin | 135/16 |
| 2004/0112416 | A1 | * | 6/2004 | Bishirjian | 135/96 |
| 2005/0016981 | A1 | * | 1/2005 | Irvin | 219/211 |

FOREIGN PATENT DOCUMENTS

| | | | | | |
|---|---|---|---|---|---|
| EP | 83148 | A2 | * | 7/1983 | 135/98 |
| GB | 2036123 | A | * | 6/1980 | 135/16 |
| GB | 2038620 | A | * | 7/1980 | |
| GB | 2060024 | A | * | 4/1981 | 135/98 |
| JP | 11-192113 | A | * | 7/1999 | |
| JP | 2003-33211 | A | * | 2/2003 | |
| JP | 2004-135985 | A | * | 5/2004 | |
| NL | 1004754 | C6 | * | 6/1998 | |

* cited by examiner

RAIN PROTECTION UMBRELLA

BACKGROUND OF INVENTION

The present invention relates to a rain protection device consisting of a lightweight waterproof material that attaches to an umbrella and a vertical stand, more particularly a rain protection device that provides full protection from environmental elements, such as wind, rain, snow, keeps the user dry, is foldable, and provides a clear view for the user.

Rainfall tends to make the simplest of tasks, such as walking or attending a ball game in an outside arena, very messy, complicated, and wet. Also, unbalanced forces of rain, falling in various directions, further complicate the goal of remaining dry.

Conventional umbrellas have long been popular devices to protect users from getting wet. Generally a conventional umbrella has a covering with arms expanding outward from a long supporting pole. The supporting mechanism supports the arms at a set space above a carrying handle when the umbrella is in an open arrangement. Although, conventional umbrellas provide some protection from the rain, often conventional umbrellas protect only the top third of the body from rainfall, thus causing the users lower body portion to become wet. As a result, the user becomes uncomfortable walking around in wet clothes, which could lead to physical illness or even embarrassment once they reach their destination. Also, conventional umbrellas often prove to be problematic to control when the weather consists of heavy rainfall and wind especially if it is blowing in several directions. Because conventional umbrellas encompass large surface areas, they tend to act similar to sails in the wind. The effect of such a design results in the user struggling with the umbrella in harsh weather. If the wind is strong, often a conventional umbrella will sway from side to side, as well as turn inside out. In the midst of such struggle the user becomes wet, thus defeating the purpose of using a conventional umbrella in the first place.

Raincoats are also employed for protection from the rain, yet such devices are often more expensive than conventional umbrellas. As the user develops and matures physically, raincoats often need to be replaced, which also adds to the expensive cost of such devices. Another drawback for raincoats includes the fact that a user must accompany a raincoat with an umbrella if they are carrying a purse or shopping bag, in order to provide protection to such items the raincoat is not covering. Thus, all the problems associated with umbrellas become problems for raincoat users as well. Another complication with using a conventional raincoat: not all raincoats are water proof, some coats are water resistant, thus users will get wet by some degree.

Raincoats fit tightly, especially if the user is wearing layers of clothes. Such a tight fit causes insufficient breathing room for the user, and tends to make the user to feel sweaty and hot under the layers of clothing. Such conditions intensify when the raincoat is constructed of a plastic material. Similar to umbrellas, raincoats keep the top half of the body dry, while a user's legs often become soaking wet due to the lack of protection for the lower one third of the body.

Rain pants can be used and must be worn over the user's normal clothes, and this has been the best method to protect the user's legs and bottom one third of their body. Yet, the user must put in time and energy to get in and out of such devices. Consequently, these devices are many times inconvenient.

Assortments of rain protection devices have been formed in an attempt to help users stay dry in the rain, yet each of these devices includes complications.

U.S. Pat. No. 4,336,817 issued to Rosella Shapiro on Jun. 29, 1982, shows a conventional umbrella device consisting of a conventional pocket or purse compartment to carry items such as money, credit cards, keys, etc. Yet, unlike the present invention, this device does not provide or increase full rain protection and is subject to many of the problems of conventional umbrella as explained previously.

U.S. Pat. No. 4,980,928 issued to Aileen Ellis on Jan. 1, 1991, shows a head and shoulder covering consisting of a cap and cape that forms an umbrella like weather protecting device. Yet, unlike the present invention the device does not provide full body and head water resistant protection from rain and it must be always used with a cap like attachment.

U.S. Pat. No. 5,050,924 issued to George G. Hansen on Sep. 24. 1991, shows an expandable tarpaulin assembly constructed of plastic or canvas material. Yet, unlike the present invention, such a device is used for large objects for example sport utility vehicles and trucks.

U.S. Pat. No. 5,664,595 issued to Eric John Vonderhorst on Sep. 9, 1997, shows a covering that forms a tent like structure for protection from insects. Yet, unlike the present invention, this particular device is formed of a net like material, and is used for optimal protection from flying insects not falling rain. The fabric does not allow for any water-resistant or water proof protection from rain or other precipitation.

U.S. Pat. No. 5,429,147 issued to Barrington on Jul. 4, 1995, is a detachable cover for an umbrella, yet unlike the present invention it does not provide any enhanced protection from rain beyond that of a conventional umbrella.

U.S. Pat. No. 6,223,758 issued to Feldman on May 1, 2001, is a novelty umbrella for a child and unlike the present invention it is not versatile enough that it can be used for adults as well as children. Plus it does not provide any enhanced protection beyond that of a conventional umbrella.

U.S. Pat. No. Des. 390,696 issued to Bauman is an opaque umbrella with a transparent panel, but unlike the present invention it does not provide for lengthy, all around water-resistant protection for the user.

Thus there is a need for an invention that protects a user from getting wet in the rain, as well as other weather elements such as hail and snow, yet is inexpensive, easily stored/carried, gives guaranteed rain protection, all while providing sufficient breathing room.

SUMMARY OF INVENTION

The present invention improves upon the various previous methods of rain protection and cited patents by being simple to use, lightweight, convenient, portable, as well as possessing features that allow for comfortable air circulation and easy storage.

The present invention is constructed of a vertical attachment shield that is attached to any pre-existing conventional umbrella. The vertical attachment shield is constructed of a lightweight material that does not permit rain to transmit or seep through the material. Such a material would also be able to reflect sunlight, thus providing sunscreen protection for the user when in use. The vertical attachment shield forms a canopy shape, when attached to a pre-existing umbrella via spring-loaded clips and small elastic nooses.

To operate, clips present along the upper rim of the vertical attachment shield, are attached to the end tips of a pre-existing umbrella, to form a cylinder canopy covering that provides optimal rain protection. Small nooses, also present along the upper rim of the vertical attachment shield, are attached to the end tips of the existing umbrella arms. Such an attachment keeps the clips from sliding up the arms and firmly secures the vertical shield attachment.

In an alternative embodiment, the present invention includes a uniquely designed umbrella along with the vertical attachment shield. Snaps are located along the underside of an otherwise conventional umbrella, and corresponding snaps are located along the upper rim of the vertical attachment shield. In order to operate, the user joins the vertical attachment shield and uniquely designed umbrella by snapping the two components along the underside of the umbrella and upper rim on the vertical attachment shield.

When the vertical attachment shield is attached to the umbrella component, the user may enter the present invention for use by unzipping or unsnapping the zipper or set of snaps that join the first surface edging to the second surface edging, and then refastening once inside the cylindrical canopy configuration. For added comfort and convenience the present invention includes a clear window for clear viewing, vent openings, large enough for proper air circulation yet small enough not to let precipitation in, and hand openings large enough to allow the average human hand to be inserted, that allow the user easy access outside the apparatus. Once inside the present invention, the user has full and optimal protection from rainfall, as well as hail, snow, or the sun's glaring rays.

A vertical umbrella stand is employed to open and close the vertical attachment shield while this component is attached to the uniquely designed umbrella. The vertical stand consists of an elongated pole with four retractable stand legs. Present along the elongated pole of the unique designed umbrella are several male screws, which can be attached to the vertical umbrella stand via a female screw socket located at several points of the elongated pole portion of the vertical umbrella stand. There is also the same assembly at the end of the elongated pole to attach the vertical stand. In another embodiment, the stand can be used in conjunction with a conventional umbrella. A user simply screws in the uniquely designed umbrella into the vertical stand, and can assemble, open, and close the vertical components of the present invention with ease and comfort. The present invention can be used in this fashion to deploy at a beach or for protection from the elements in an outdoor environment.

The present invention is equipped with a carrying case to carry the compacted rain protection device with more ease. The bag is constructed of a lightweight material, with a drawstring closure and a shoulder-carrying strap.

DETAILED DESCRIPTION

Figure 1:
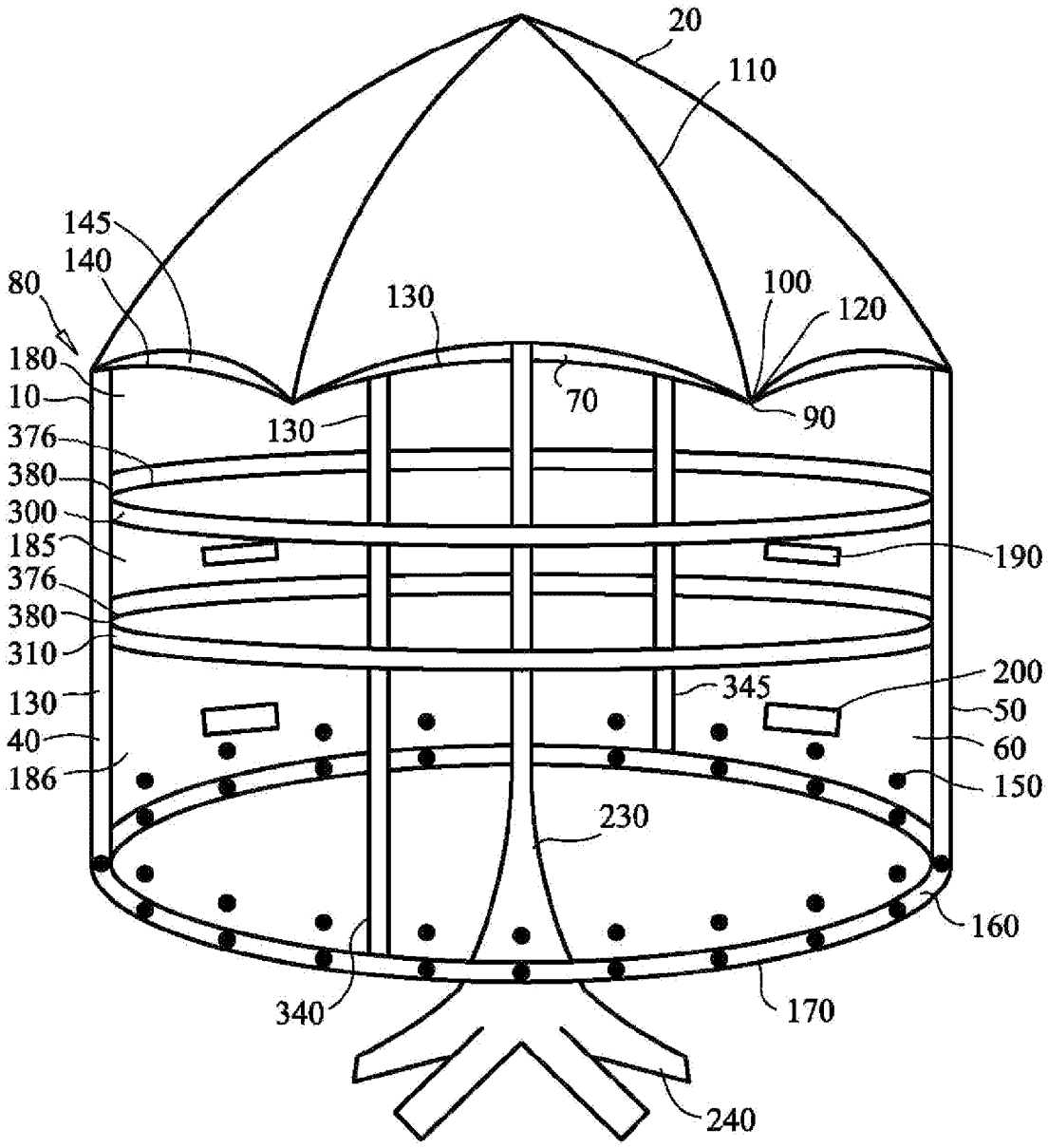
FIG. 1 shows the present invention in use attached to a conventional umbrella.
Figure 4:
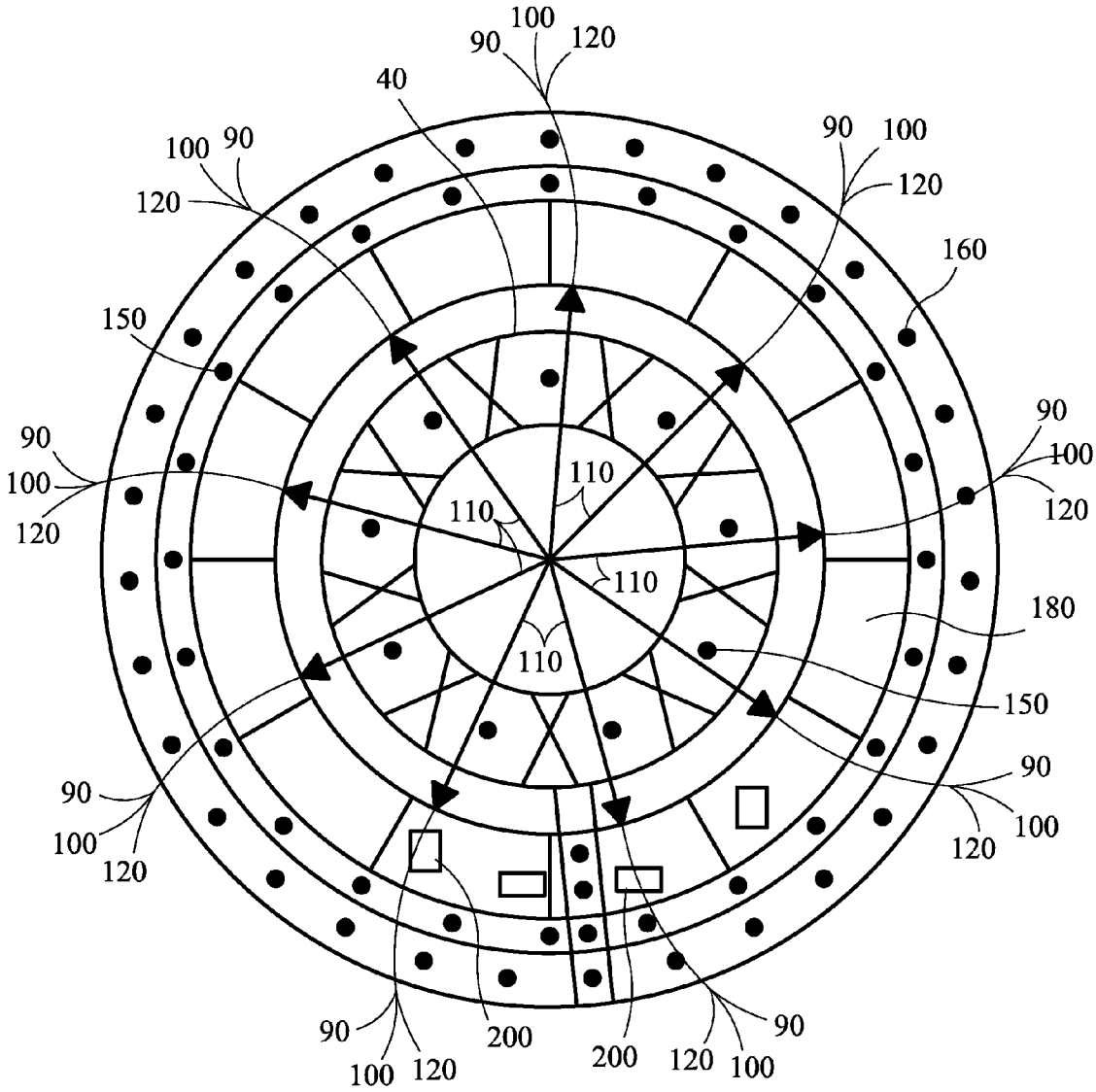
FIG. 4 shows a top view looking downward perspective of the present invention.

Referring to FIG. 1 and FIG. 4, the present invention is an umbrella rain protection device that includes a lightweight, waterproof vertical attachment shield (10), and several other accessories explained below that connect to any pre-existing conventional umbrella (20). The present invention provides full protection for the user from getting wet due to precipitation.

The present invention has a vertical attachment shield (10), preferably constructed of several connecting long, rectangular pieces of transparent waterproof material, preferably nylon or plastic. It can be made of other appropriate material that is lightweight enough to allow proper air circulation to create a breathable, cool temperature setting for the user, and also a protective canopy structure that protects against falling rain seeping through. Yet, such material is also durable so that when the present invention is in use, the vertical attachment shield (10) may act as a wind blocker and prevent hail, snow and any other precipitation from passing through. As a result, the use of such material will allow the user to remain dry as well as comfortable in the midst of falling precipitation. The material allows the present invention to be easily folded up after drying and put away for future use. In an alternative embodiment, the vertical attachment shield (10) can be made of material that allows the user to see out of the deployed present invention, but does not allow passers by and observers to see the user through the vertical attachment shield (10). Or the material of the present invention can be made such that the user can have a 180-degree view and the other 180 degrees can be opaque.

The present invention has several series of zippers. The series of zippers allow for the present invention to vary in length. The vertical attachment shield (10) can be separated and zipped off by using the horizontal zippers (300, 310 and 145). These horizontal zippers are located at three different levels on the vertical attachment shield (10). Each zipper can be zipped entirely off and by doing this the entire length of the present invention can be changed.

The vertical attachment shield (10) length can be adjusted to three different lengths to suit the needs of the user. If the user wants to use the present invention as an umbrella with enough protection to cover the area just below the shoulders, they would use the horizontal zipper (300) to zip away and remove the lower portion of the present invention. If the user wants to use the present invention as an umbrella with enough protection to cover three quarters of the body area, then they would zip off the horizontal zipper (310). If the user wants to use the full length of the present invention the first horizontal zipper (300) and second horizontal zipper (310) are both attached and serve to join all sections, (180, 185 and 186) clear window view sections of the vertical shield attachment (10) and the present invention is then in the full-length version.

There are several horizontal zippers (300, 310 and 145). The horizontal zippers (300 and 310) change the length of the vertical attachment shield (10) and horizontal zipper (145) attaches the vertical attachment shield (10) to a conventional umbrella (20). The horizontal zipper (145) attaches and secures the vertical attachment shield (10) onto a conventional umbrella (20), along the underside (140). The horizontal zipper (145) and snap buttons (130) are not clearly visible, but they work to secure the vertical attachment shield (10) to either a conventional umbrella (20) or a unique design umbrella, and provide a means for securing the side vertical zipper (40) so that no precipitation can get through to the user. At each connection point, this series of snaps buttons (130) and zippers (40, 145, 300, 310, 340 and 345) allow either the vertical attachment shield (10) to be attached to the conventional umbrella (20), and the feature provides a secure connection of all components of the present invention to ensure that the user remains dry. The snap buttons (130) and horizontal zipper (145) allow for a conventional umbrella to be used with or without the vertical attachment shield (10).

The present invention has a side vertical zipper (40) located on each side of the vertical shield attachment (10) and on the front and back there is a front vertical zipper (340) and back vertical zipper (345). At each zipper (40, 340, 345, 145, 300 and 310) there is a series of snaps buttons (130) to ensure that the closures are secure. These series of zippers (40, 340, 345, 145, 300 and 310) and snap buttons (130) are covered by an attached conventional flap of material (70), so that they are not exposed and not visible. The side vertical zipper (40) is located between the first surface edging (50) and the second surface edging (60) of the vertical attachment shield (10). The vertical zipper (40) on each side is utilized to form a cylinder shape by joining the first surface edging (50) to the second surface edging (60) and then securing them both with the vertical zipper (40), snap buttons (130). At the intersection (380) of the horizontal zippers (300) and (310) with the side vertical zippers (40), there is a transfer mechanism (376) that allows each sets of zippers to pass the intersection (380) without interfering with the function of the other zippers (145, 40, 340, 345, 300, and 310).

In an alternative embodiment other suitable fastening means are used to secure and connect the vertical attachment shield (10) to a conventional umbrella (20), or devices used in conjunction with the vertical shield (10).

In conjunction with the zippers (145, 40, 340, 345, 300, and 310), and at each place there are zippers, there are snap buttons (130) to secure all removable parts of the present invention to make sure that no water, wind or precipitation leaks through. Also along the bottom edge of the vertical attachment shield (10), there is a row of snap buttons (150) and corresponding snap buttons (160) to adjust the lower length of the vertical attachment shield (10).

Figure 3:
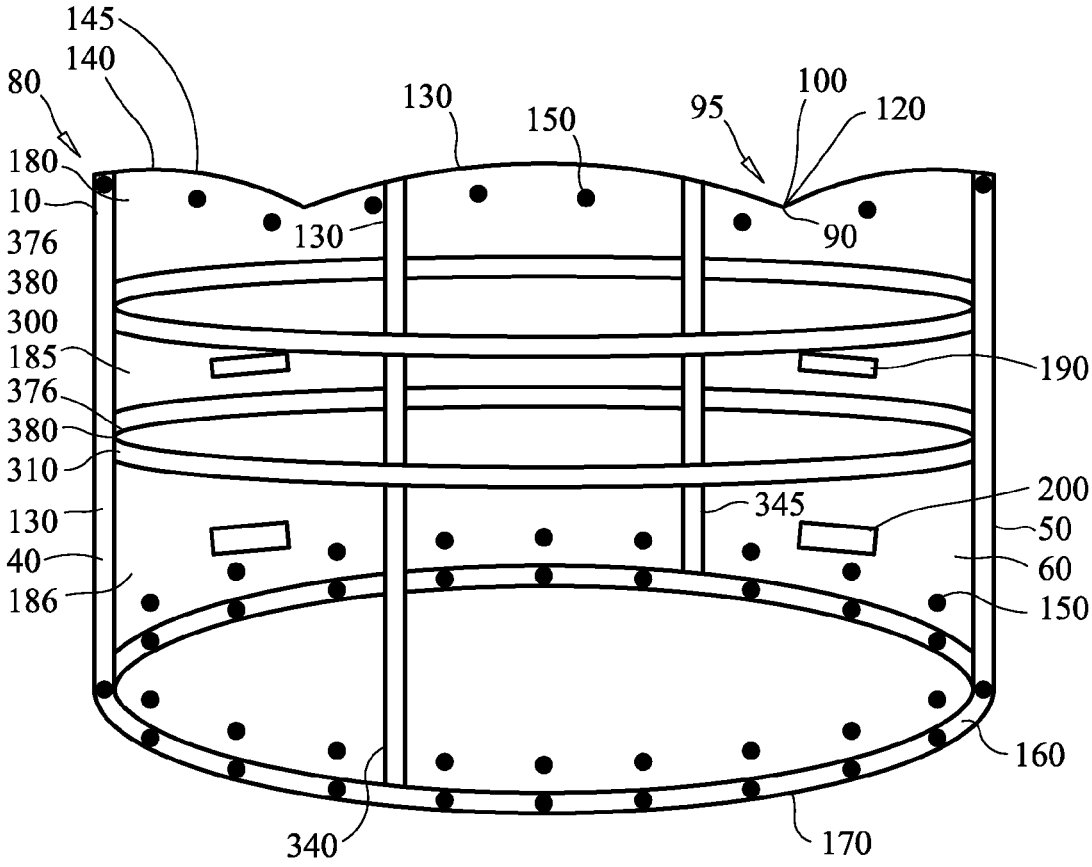
FIG. 3 shows an open flat view of the vertical shield attachment.

The upper rim (80) of the vertical attachment shield (10) is attached to the underside (140) of any pre-existing conventional umbrella (20) by the use of spring loaded plastic clips (90) and elastic nooses (100) that attach to the umbrella arms (110) and end tips (120). Spring loaded plastic clips (90), located around the upper rim (80) of the vertical attachment shield (10), clamp on to the umbrella arms (110) of the pre-existing conventional umbrella (20). Small elastic nooses (100), located along the upper rim (80) if the vertical attachment shield (10), can be attached to the end tips (120) of the umbrella arms (110), in order to ensure the plastic clips (90) remain stable in place, thus preventing the plastic clips (90) from sliding up and down the umbrella arms (110). The plastic clips (90) and elastic nooses (100) allow the vertical shield attachment (10) to be removed from or attached to any pre-existing conventional umbrella (20). As shown in FIG. 3, the point of connection (95) is where the spring loaded clips (90), elastic nooses (100) and end tips (120) connect to the vertical attachment shield (10). Also, as shown in FIG. 3, snap buttons (150) are shown in a top row.

The vertical attachment shield's (10) width is enough to extend the space amid the point of attachment to the conventional umbrella (20), and a few inches above the ground, when the present invention is in use. A first row of snap buttons (150) along with a parallel second row of corresponding snap buttons (160) align the lower rim (170) of the vertical attachment shield (10), in order to provide varying lengths of the present invention for the user. The present invention can be shortened by joining together the second row of corresponding snap buttons (160) to the first row of snap buttons (150). This feature allows the present invention to be suitably adjusted to the users height or preferential length of coverage. Thus, the present invention can be employed by both children and adults and provides optimal protection from rainfall and other precipitation.

The vertical attachment shield (10) contains several clear window viewer sections (180, 185 and 186), the first clear window viewer section (180) is located at eye level underneath the upper rim (80), the second clear window viewer section (185) is located immediately below the first one and the third clear window viewer section (186) is directly below the second clear window viewer section 185. All together there are three adjacent sections, (180, 185 and 186) of clear plastic, waterproof material. These adjacent sections (180, 185 and 186) allow the user complete visibility 360 degrees when they are inside the deployed present invention. The three levels of clear plastic waterproof material making up the clear window viewer adjacent sections (180, 185, and 186), which allows the user a clear front, side, and rear view, thus the user can see where he or she are going, preventing the user from falling due to an uneven sidewalk, curb, etc. In an alternative embodiment, the vertical attachment shield (10) can only have 180 degree viewable clear plastic material so that the back 180 degree view is opaque, which would not allow the user to see out the back, nor will passers by be able to see the user from the back. In this alternative embodiment, the clear plastic view material covers only the front three adjacent sections so only clear 180 degree, thus allowing the user only half the visibility afforded in the first embodiment described. In the alternative embodiment, the user can only see on each side and in front of them, the user can not turn the present invention around 180 degrees and see out because the back is opaque. In yet another embodiment, the vertical attachment shield (10) is made of a material that allows the user to see out, but does not allow others to see into the deployed present invention while in use.

Also located on the vertical attachment shield (10) are air vent openings (190) and hand openings (200). The air vent openings (190) are cut like enhancements that allow air inside when the present invention is deployed; they also improve air circulation accordingly and allow the user additional comfort and the ability to breath while using the present invention. The hand openings (200) provide a means by which the user can extend their hands and/or arms through the hand opening (200) to the outside when the present invention is deployed. This feature allows the user to reach items outside that are not underneath the present invention. This feature also allows the user to grasp onto handles, stair and support rails, door handles, vending machinery, and other items.

Figure 2:
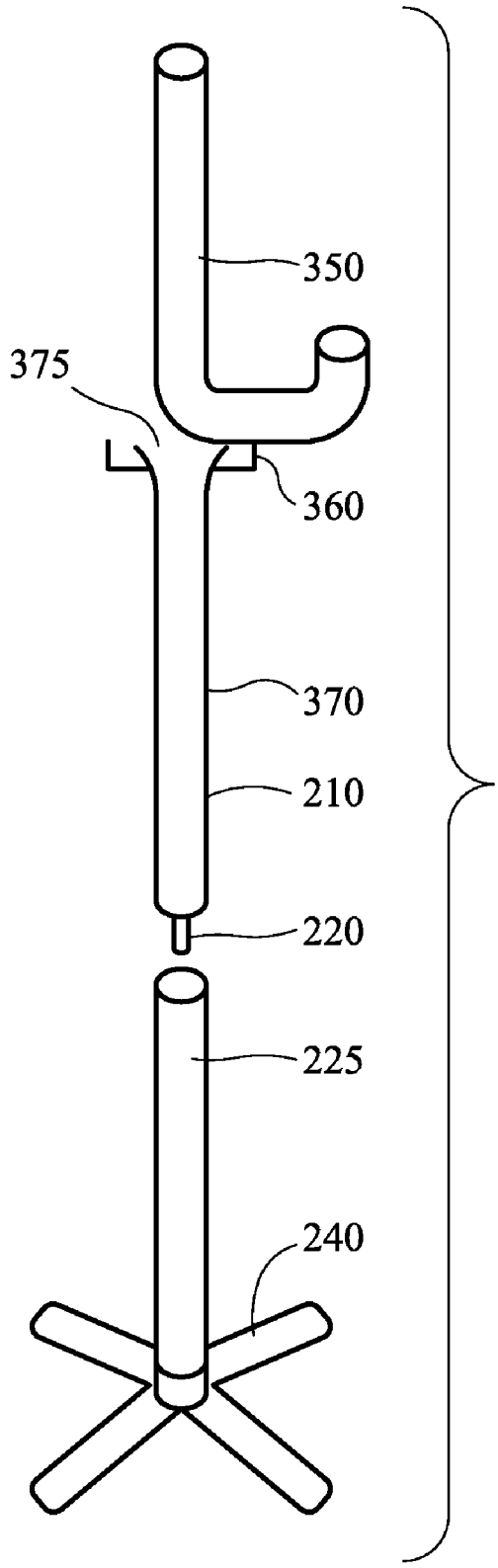
FIG. 2 shows the vertical stand for the present invention.

To use the present invention, as shown in FIG. 2, wherein a vertical umbrella stand (210) is employed, the conventional umbrella bottom handle (350) can be attached to a "U" stand (370), with a hinge latching mechanism (360) to secure the handle (350) of the conventional umbrella (20) into the stand 210. Each section of vertical umbrella stand (210) attaches via a male screw (220) located on the bottom of each portion of each piece of the umbrella stand (210) stand and it screws into the female end 225 at the top of each section. The bottom portion of the vertical umbrella stand (210) has an attachment of four retractable legs (240). Using the vertical umbrella stand (210) enables the user to attach the vertical attachment shield (10) to the underside (140) of the conventional umbrella (20), and the user to open and close the present invention with ease and comfort.

In this alternative embodiment, the umbrella stand (210) can come with an attachment so the present invention can be used even when the user has attached the present invention onto a conventional umbrella (20) that ends with a handle that curves upward like a "U". The alternative "U" stand (370) has a slot (375) at the tip so that the conventional umbrella (20) can fit into the alternative "U" stand 370. The hinge locking mechanism (360) secures the "U" handle of the conventional umbrella (20) in place. This will allow the user to use the present invention and still have use of both their hands. When used in this manner, the user can rest the conventional umbrella (20) in the alternative "U" stand (370) and have their hands free. This also allows a user the flexibility of obtaining only the vertical attachment shield (10), shown in FIG. 3, which attaches to the conventional umbrella and the alternative "U" stand (370), of the present invention for attaching to a conventional umbrella, yet still being able to enjoy all the features intended to be part of the present invention.

Once the user is underneath the deployed the present invention, the user can put their hands outside the hand openings (200) and reach objects outside the present invention, and can make adjustments to the present invention. The user can reach and proceed to utilize the zippers (40), and join the first surface edging (50) to the second surface edging (60) by zipping the two edges up. The user can also reach all the other series of zippers (40,145,300,310, 340 and 345) and snap buttons (130) by extending their hands through the hand openings (200). The user can also reach and utilize the snap buttons (150) to lengthen or shorten the vertical attachment shield (10), or to secure the connections of the present invention. In an alternative embodiment the user may join the first surface edging (50) to the second surface edging (60) by utilizing a set of snap buttons (130) and snapping together the two sides.

Shown in FIG. 4, the present invention is shown from a downward view. This view shows the umbrella arms (110), points of connection of spring loaded plastic clips 90 at the end tips (120) in conjunction with the elastic nooses (100), clear window viewer (180, 185 and 186), zipper (40), hand openings (200), air vents (190), snap buttons (150) and corresponding snap buttons (160). Also FIG. 4 shows the overhead view of how the individual components of the present invention relate and how these components are necessary to ensure that no rain or other precipitation seep through to the user.

Figure 5:
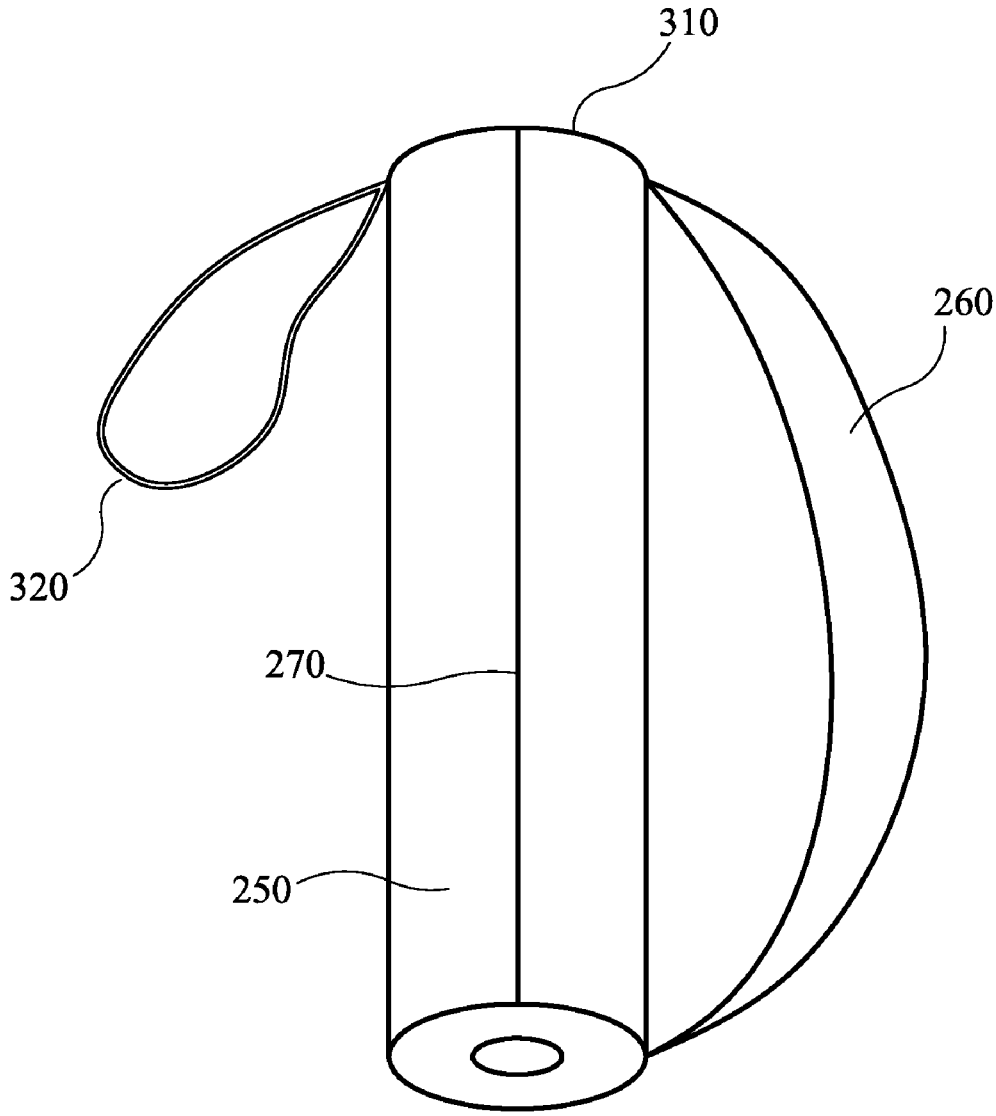
FIG. 5 shows the carrying case of the present invention.

Shown in FIG. 5, the present invention is also equipped with a carrying case (250) to carry the compressed present invention with more ease. The carrying case (250) is constructed of a lightweight material, such as waterproof plastic or silk, and has a shoulder-carrying strap (260), made of a durable, waterproof material. The carrying case (250) also has a zipper (270) for the easy opening and closing of the carrying case (250). The zipper (270) goes along the side of the carrying case (250). The top of the carrying case (250) has an inner sewn flap (330) that contains a drawstring (320) used to close the top of the carrying case (250). When the user is finished using the present invention for rain protection, they can fold the present invention, place it in the carrying case (250) and use the drawstring (320) to close the carrying case (250). This allows for the carrying case (250) to be closed securely and allows the present invention to be transported and stored with ease and little effort.

The present invention has benefits not present in other know rain protection devices in that the present invention is foldable, convenient, and provide full optimal protection from rain while, while providing sufficient air circulation for the user.

It is intended and should be understood that the invention is not limited to the particular embodiment released and the above mentioned description of the invention is simply to be illustrative and that the present invention will contain other embodiments, modifications, that fall within the attached claims.

The invention claimed is:

1. A rain protection device comprising:

an umbrella having an outer circumference;

a first shield, spanning 180 degrees under and around the circumference of said umbrella;

a second shield, disposed adjacent to said first shield, spanning 180 degrees under and around the circumference of said umbrella;

a third shield, disposed under said first shield, spanning 180 degrees under and around the circumference of said umbrella;

a fourth shield, disposed under said second shield, spanning 180 degrees under and around the circumference of said umbrella;

a fifth shield, disposed under said third shield, spanning 180 degrees under and around the circumference of said umbrella;

a sixth shield, disposed under said fourth shield, spanning 180 degrees under and around the circumference of said umbrella;

said first and second shields removably attached to the umbrella;

a first zipper and a second zipper, running vertically below said umbrella, removably connecting said first shield to said second shield, said third shield to said fourth shield, and said fifth shield to said sixth shield;

a third zipper, running horizontally below said umbrella, removably connecting said first shield and said second shield to said third shield and said fourth shield; and a fourth zipper, running horizontally below said umbrella, removably connecting said third shield and said fourth shield to said fifth shield to said sixth shield, and wherein, said vertical zippers removably attach said shields together into a cylindrical shaped attachment shield, said horizontal zippers are configured to change a length of said cylindrical shaped attachment shield, and each of said shields of said cylindrical shaped attachment shield is able to be electively removed from the vertical and horizontal zippers.

* * * * *